US010633937B2

(12) United States Patent
Johnston et al.

(10) Patent No.: US 10,633,937 B2
(45) Date of Patent: Apr. 28, 2020

(54) LIFT FRAME SYSTEM AND METHOD OF USE

(71) Applicant: HELIX ENERGY SOLUTIONS GROUP, INC., Houston, TX (US)

(72) Inventors: Colin Johnston, Houston, TX (US); Paul Shotton, Aberdeenshire (GB)

(73) Assignee: Helix Energy Solutions Group, Inc., Houston, TX (US)

( * ) Notice: Subject to any disclaimer, the term of this patent is extended or adjusted under 35 U.S.C. 154(b) by 589 days.

(21) Appl. No.: 14/504,967

(22) Filed: Oct. 2, 2014

(65) Prior Publication Data

US 2015/0090464 A1 Apr. 2, 2015

Related U.S. Application Data

(60) Provisional application No. 61/885,866, filed on Oct. 2, 2013.

(51) Int. Cl.

| | |
|---|---|
| ***E21B 19/02*** | (2006.01) |
| ***E21B 19/00*** | (2006.01) |
| ***E21B 19/22*** | (2006.01) |
| ***E21B 15/02*** | (2006.01) |
| ***E21B 19/04*** | (2006.01) |
| ***E21B 19/07*** | (2006.01) |
| ***E21B 19/06*** | (2006.01) |
| ***E21B 3/02*** | (2006.01) |

(52) U.S. Cl.

CPC ..... *E21B 19/02* (2013.01); *E21B 3/02* (2013.01); *E21B 15/02* (2013.01); *E21B 19/00* (2013.01); *E21B 19/002* (2013.01); *E21B 19/04* (2013.01); *E21B 19/06* (2013.01); *E21B 19/07* (2013.01); *E21B 19/22* (2013.01)

(58) Field of Classification Search

CPC . E21B 19/02; E21B 3/02; E21B 19/04; E21B 19/06; E21B 19/07

See application file for complete search history.

(56) References Cited

U.S. PATENT DOCUMENTS 3,789,936 A * 2/1974 McCullough ..... E21B 49/00 175/50

5,467,833 A 11/1995 Crain et al.

(Continued)

FOREIGN PATENT DOCUMENTS

| | | |
|---|---|---|
| EP | 2186993 | 5/2010 |
| WO | 2011135541 | 11/2011 |

OTHER PUBLICATIONS

PCT Search Report for PCT Application No. PCT/US2014/058877 dated Oct. 9, 2015.

(Continued)

*Primary Examiner* — Tara E Schimpf

(74) *Attorney, Agent, or Firm* — Locke Lord LLP

(57) ABSTRACT

A lift frame system and method of use including a lift frame capable of being moved from a stowed position to a drill center position and a skidding pallet with at least one personnel access and egress walkway platform. The skidding pallet is capable of moving along a plurality of rails and engaging a multipurpose tower. The lift frame may include levels, a coiled tubing injector, at least one pressure control equipment, stabilizing arms, a top drive, a hook, and a set of bails.

16 Claims, 7 Drawing Sheets

(56) References Cited

U.S. PATENT DOCUMENTS

| | | | | |
|---|---|---|---|---|
| 8,511,385 | B2 * | 8/2013 | Sorenson | E21B 19/22 166/339 |
| 9,611,706 | B2 * | 4/2017 | Pinckard | E21B 19/006 |
| 2012/0018166 | A1 * | 1/2012 | Croatto | E21B 19/006 166/355 |
| 2012/0234549 | A1 * | 9/2012 | Lammertink | E21B 15/02 166/340 |
| 2014/0224499 | A1 * | 8/2014 | Sanders | E21B 19/00 166/339 |
| 2014/0231089 | A1 * | 8/2014 | Labrugere | E21B 15/003 166/344 |

OTHER PUBLICATIONS

PCT Written Opinion for PCT Application No. PCT/US2014/058877 dated Oct. 9, 2015.

EP Search Report for EP Application No. 14790883.4 dated Nov. 27, 2017.

* cited by examiner

LIFT FRAME SYSTEM AND METHOD OF USE

CROSS REFERENCE TO RELATED APPLICATIONS

This nonprovisional application for patent claims priority to, and hereby incorporates by reference, U.S. Provisional Application Ser. No. 61/885,866, entitled "Lift Frame System and Method of Use," filed Oct. 2, 2013.

BACKGROUND OF THE INVENTION

Technical Field of Invention

The invention disclosed and taught herein relates generally to a system and method of use of a lift frame system in offshore environments.

Description of Related Art

Lift frames have been used to position topside equipment temporarily within the handling equipment offshore on floating installations to provide a work window for equipment and operations handling. A need exists to enable safe rig up and rig down of the lift frame and associated equipment as well as safe access and operating conditions once the lift frame is in place within the handling equipment.

SUMMARY OF THE INVENTION

The present invention provides a stable platform with improved access to equipment to concentrate on making a safe man access system and safe equipment handling to the heaving topside equipment.

The invention uses a substantial coiled tubing/wire line ("CT/WL") intervention frame at topside hung off the derrick tower elevators as per todays standard operations. Wire line may include electrical line and slick line operations. The design of the lift frame enables CT/WL equipment to be maintained in the vertical operational position prior to and during rig up as well as rig down. Additionally, it is possible to switch between well service requirements without the need to rig up and rig down equipment when operational mode changes are required between CT and WL.

Traditionally when a downhole tool change out, or other maintenance requirement, necessitated personnel on the lift frame the personnel and their tools would access the lift frame via tuggers or winches transferring equipment to the stationary lift frame from the heaving rig floor level. Once the tool change out/maintenance was completed the personnel would return to deck level via the same tuggers or winches.

The improvements afforded by the invention are the provision of significant work access platforms within the lift frame for personnel access. Additionally the CT/WL equipment is maintained in operating position within the lift frame at all times and handling of equipment during operations is eliminated or minimized. Further switching between required services of either CT or WL is facilitated with a skidding table arrangement enabling quick service change out and access to the well.

The personnel access walkway is connected whilst rigging up the lift frame in a static position and remains connected throughout operation, providing safer access and egress.

The lift frame may contain both WL and CT pressure control equipment ("PCE") as well as a CT injector.

W/L and CT can be deployed by skidding the appropriate PCE over the well center within the lift frame.

The lift frame also includes winches and deployment aids for loading or removing tool strings from riser.

Personnel access is provided to work platforms within the frame for personnel to work on the lift frame whilst connected to the well.

The present invention provides for a lift frame system and method of use including a lift frame capable of being moved from a stowed position to a drill center position and a skidding pallet with at least one personnel access and egress walkway platform. The skidding pallet is capable of moving along a plurality of rails and engaging a multipurpose tower. The lift frame may include levels, a coiled tubing injector, at least one pressure control equipment, stabilizing arms, a top drive, a hook, and a set of bails.

DESCRIPTION OF THE DISCLOSED EMBODIMENTS

The drawings described above and the written description of specific structures and functions below are presented for illustrative purposes and not to limit the scope of what has been invented or the scope of the appended claims. Nor are the drawings drawn to any particular scale or fabrication standards, or intended to serve as blueprints, manufacturing parts list, or the like. Rather, the drawings and written description are provided to teach any person skilled in the art to make and use the inventions for which patent protection is sought. Those skilled in the art will appreciate that not all features of a commercial embodiment of the inventions are described or shown for the sake of clarity and understanding.

Persons of skill in this art will also appreciate that the development of an actual, real-world commercial embodiment incorporating aspects of the inventions will require numerous implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top,"

"bottom," "left," "right," "upper," "lower," "down," "up," "side," and the like, used in the written description are for clarity in specific reference to the drawings and are not intended to limit the scope of the invention or the appended claims.

Figure 1:
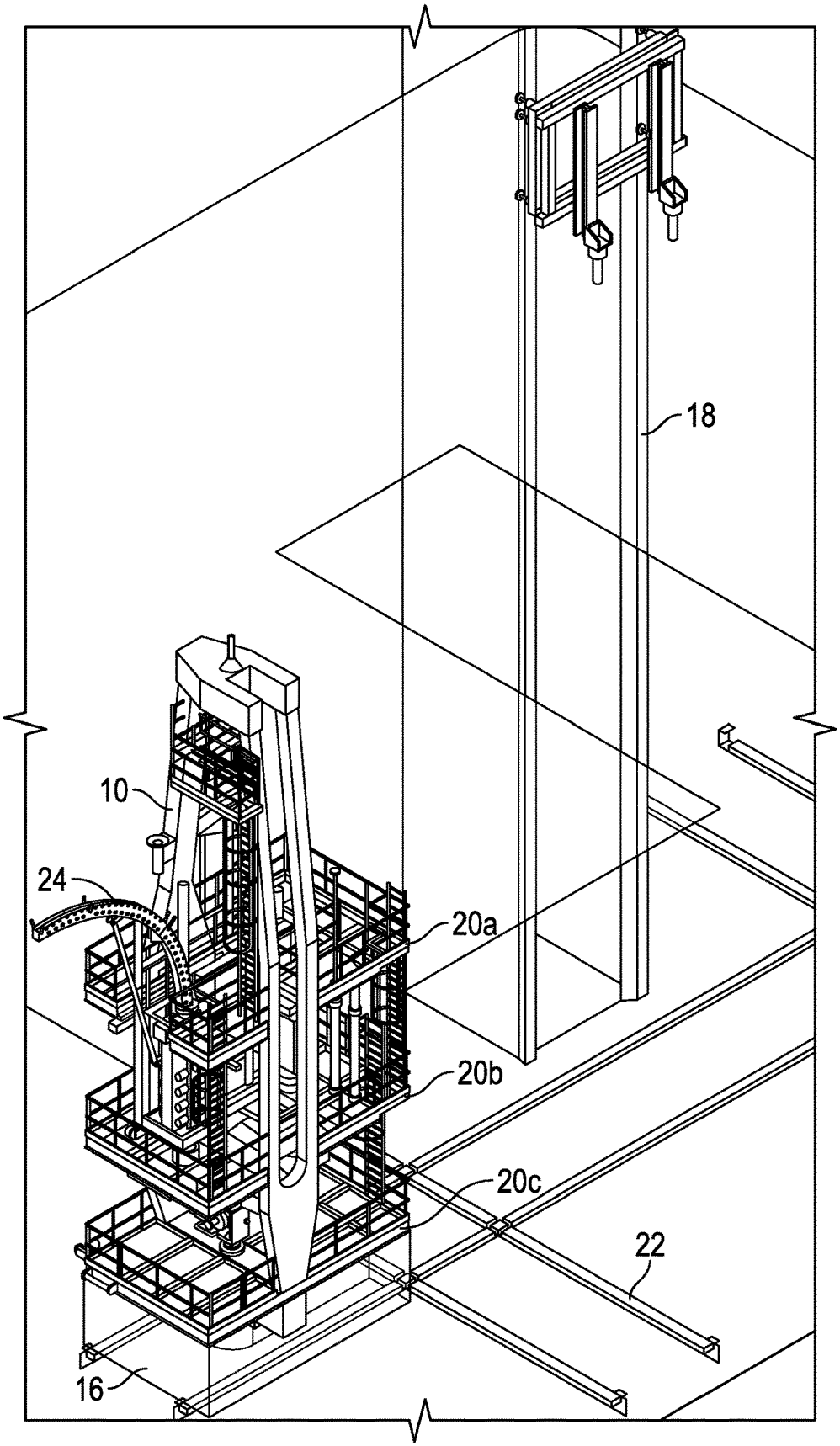
FIG. 1 shows a perspective view of the lift frame system in offline stowed position.
Figure 2:
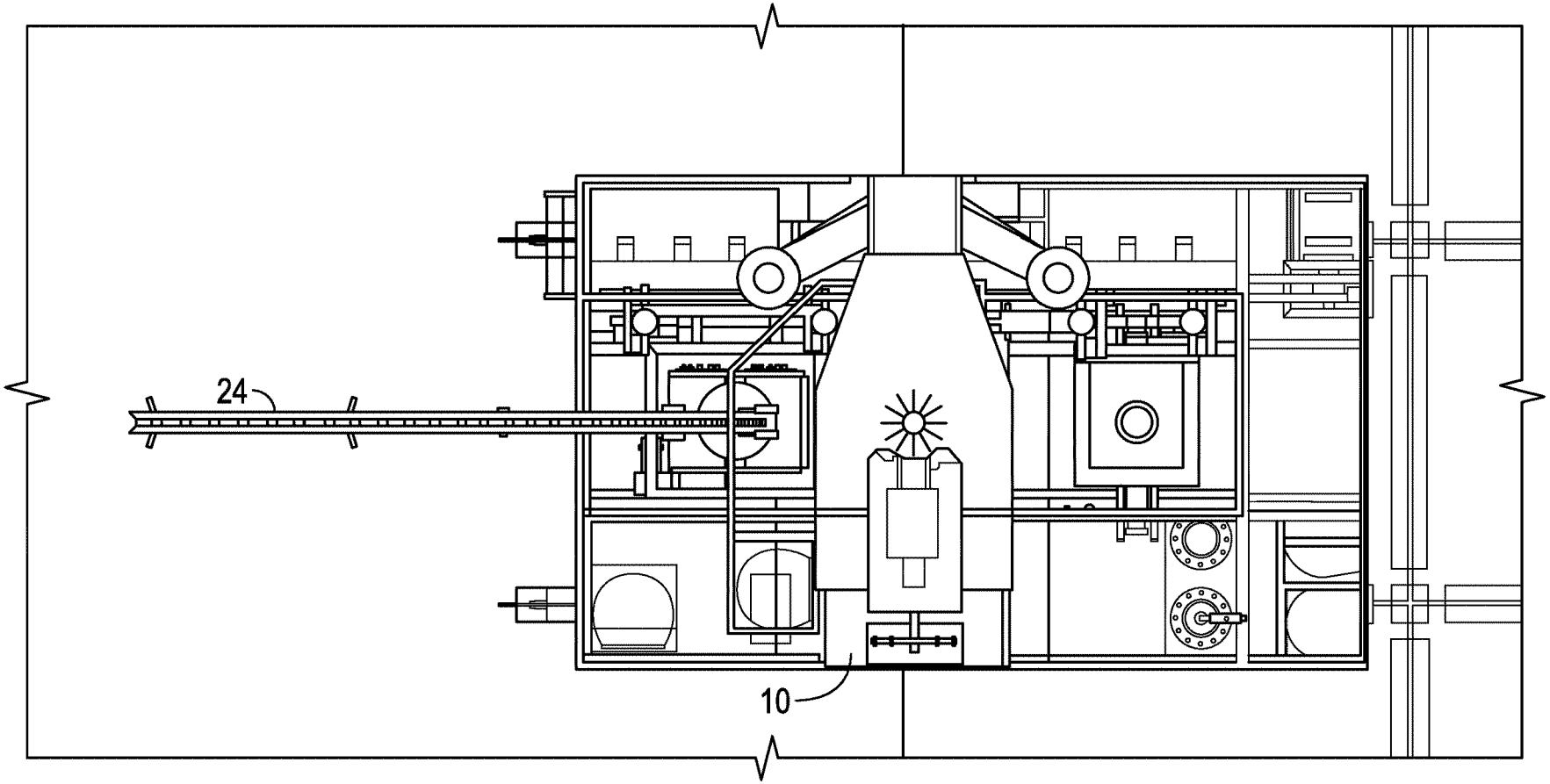
FIG. 2 shows an overhead view of the life frame system in an offline stowed position.
Figure 5:
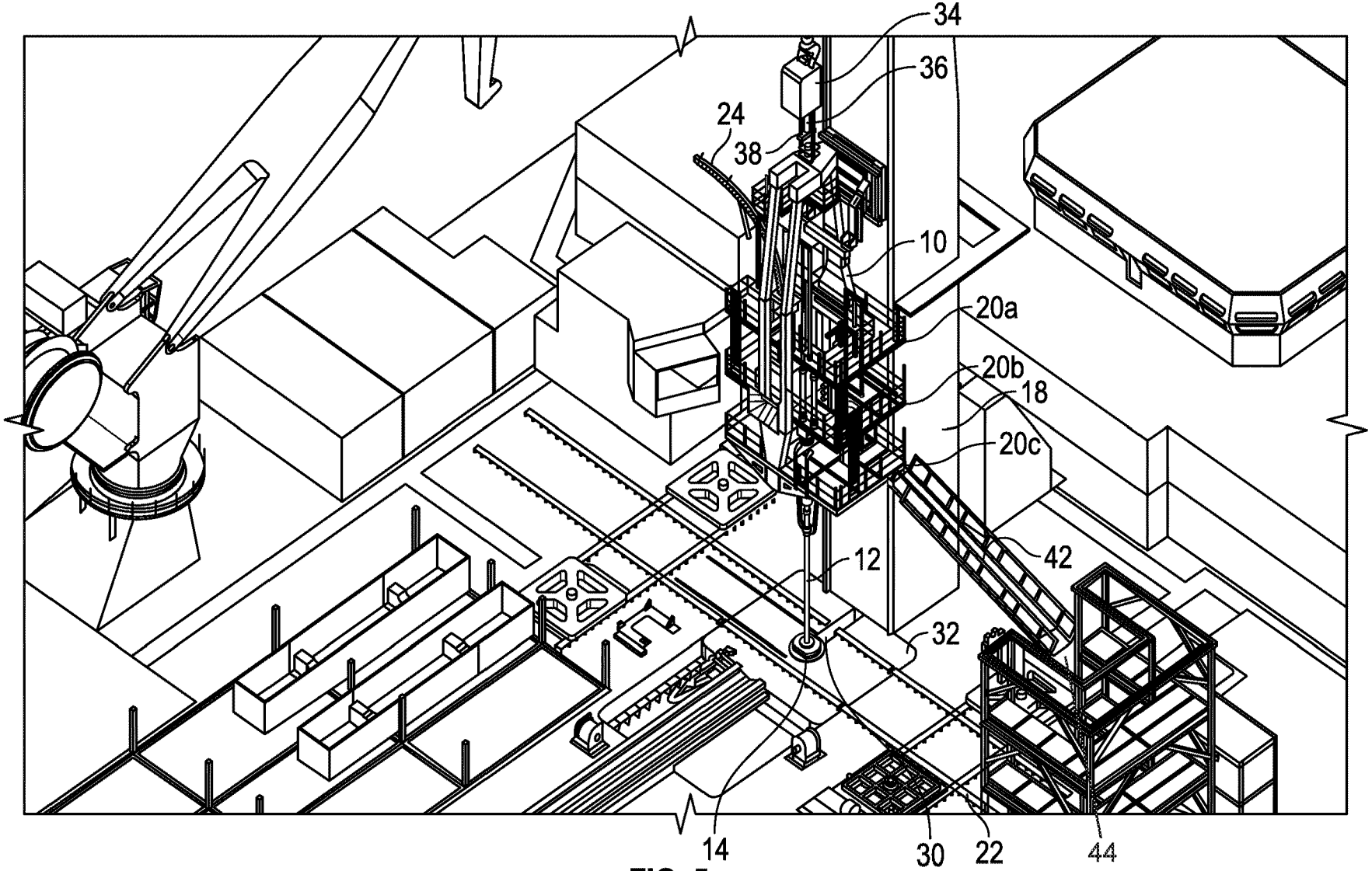
FIG. 5 shows the lift frame system during pick up for operations with the riser connection being made up.

FIGS. 1 and 2 show a lift frame structure 10. The lift frame 10 provides a means of storing and transferring CT/WL equipment 12 as shown in FIG. 5 from an offline/storage position shown in FIGS. 1 and 2 to a drill center 14 shown in FIG. 5 without the need for separate handling of individual CT or WL equipment 12. The lift frame 10 may be used in rig and vessel environments. As shown, a skidding pallet 16 is transferring the lift frame 10 toward the multipurpose tower 18 ("MPT"). The lift frame 10 is shown with a preferable three working access platforms 20*a*, 20*b*, and 20*c*. The lift frame 10 may be moved along the rails 22 while on the skidding pallet 16.

The lift frame 10 may include different elements to aid in the use of the lift frame in operation situations. For example, the preferred embodiment of the lift frame 10 shown includes a CT injector 24 and at least one pressure control equipment 26 ("PCE"). As shown, the PCE 26 is shown on working access platform 20*c*, but additional PCEs may be inline or stored on any working access platforms 20*a*, 20*b*, or 20*c* of the lift frame 10.

Figure 3:
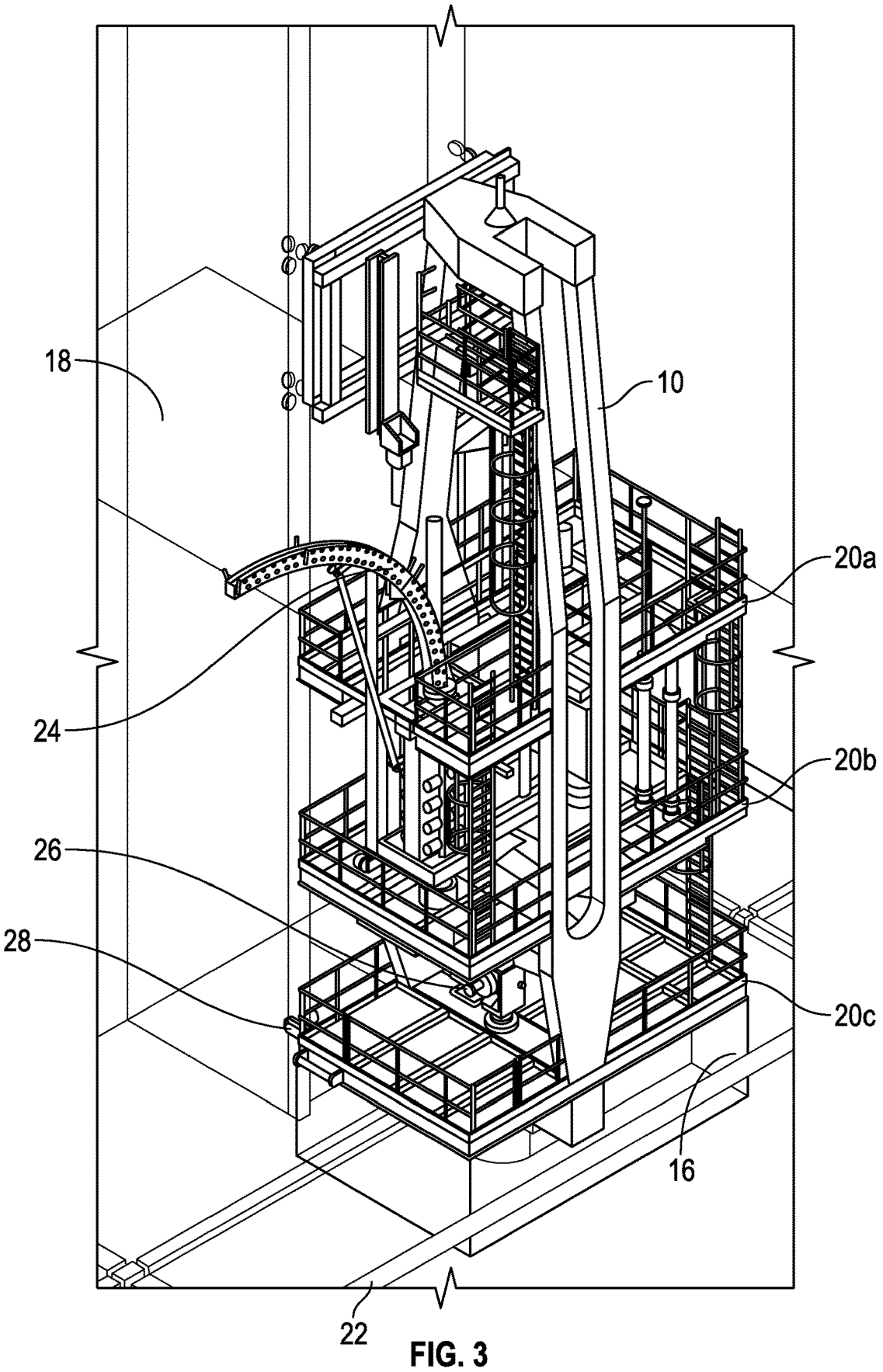
FIG. 3 shows a perspective view of the lift frame system at drill center prior to make up to the riser and pick up for operations.

FIG. 3 shows the lift frame 10 skidded into a drill center position with the MPT 18. Stabilizing arms 28 engage with the MPT 18 when in this position.

Figure 4:
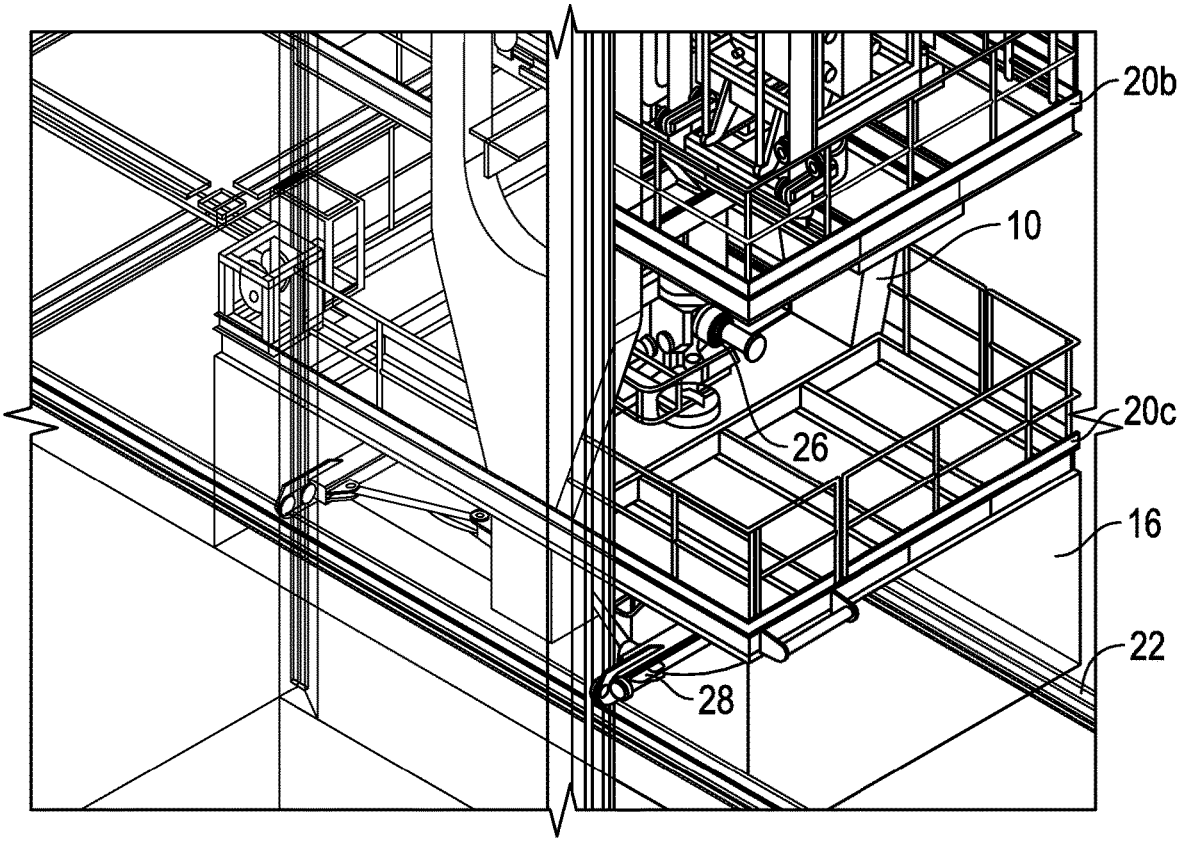
FIG. 4 shows a perspective, close-up view of the lift frame system at drill center prior to pick up for operations.

FIGS. 4 and 5 show the lift frame 10 in a lifting position. The lift frame 10 is lifting CT/WL 12 into position as the lift frame 10 is being drawn up the MPT 18 in FIG. 5. The final riser connection is handled and made up at the drill center 14 at the rotary hole 30 below the lift frame 10 but above the drill floor/moonpool door 32. Additionally, the personnel access and egress walkway platform 42 is shown, connecting the personnel access and egress walkway platform 42 between the lift frame 10 and an elevated platform 44.

Figure 6:
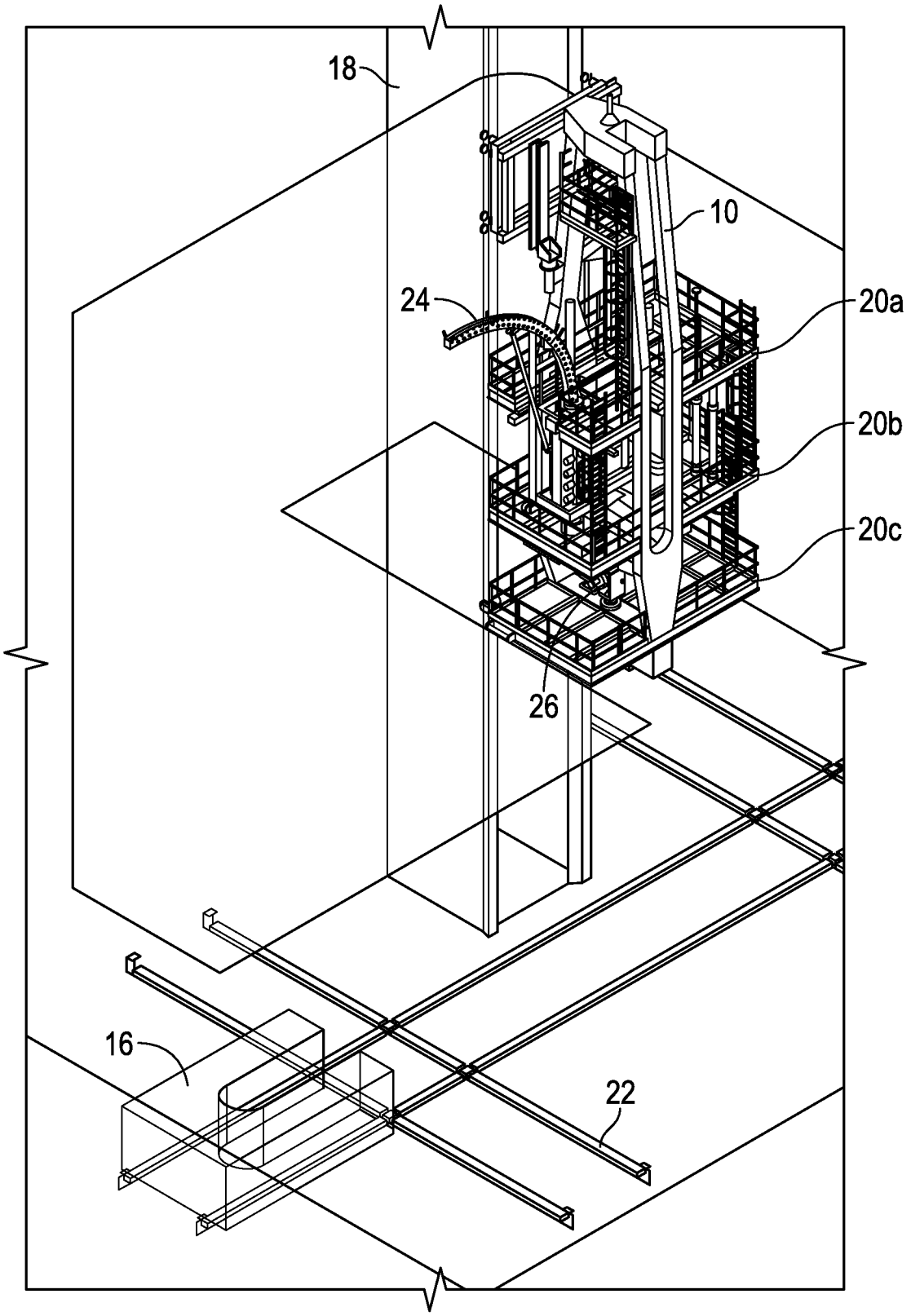
FIG. 6 shows a perspective view of the lift frame system in an operating position.
Figure 7:
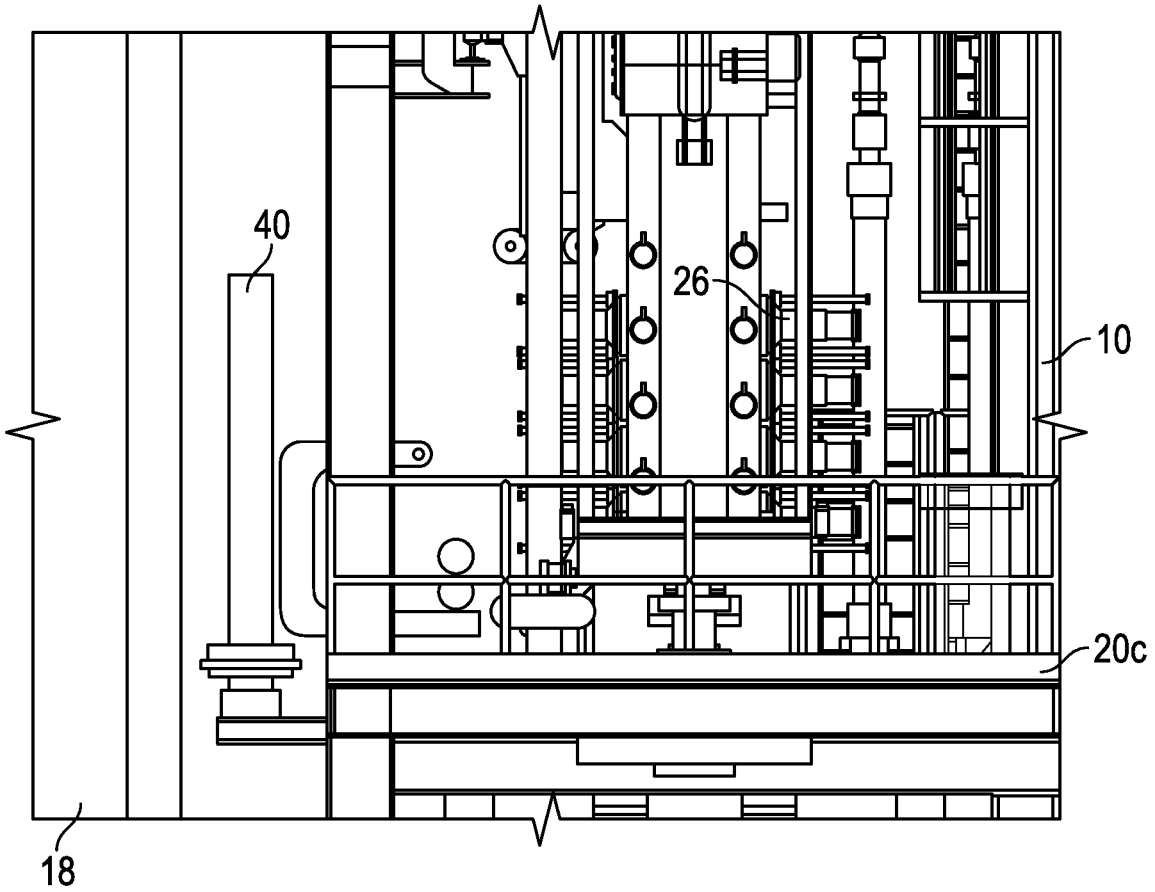
FIG. 7 shows a close-up side view of the lift frame system in an operating position.

FIGS. 6 and 7 show the lift frame 10 positioned over the drill center 14 of the rotary hole 30 as the lift frame 10 has risen up the MPT 18 and is made up to the riser enabling full well access. The lift frame 10 enables CT/WL service change out without the need to remove equipment from within the lift frame 10. The skidding pallet 16 provides the means by which either CT or WL 12 can be moved from storage position to drill center 14 and back again without the need to lower the equipment to deck level. The lift frame 10 structure enables sufficient working space such that personnel are free to move within the lift frame 10 unencumbered as required for operational reasons.

The present invention may use an alternative layout in which the drill floor remained landed out at main deck during ops and a very large intervention frame 10 itself latched onto the MPT 18 cursor rails. This embodiment of the lift frame 10 may contain three working access platforms 20*a* 20*b* and 20*c*. The working access platform 20*c* would be dedicated to a PCE 26 which could skid off drill center 14, still fully within the lift frame 10. The working access platform 20*b* can be dedicated to CT injector/WL lubricators which can slide within the lift frame 10 off drill center 14. The working access platform 20*a* provides access to the CT injector/WL lubricators equipment as required during operations.

The lift frame 10 should also contain safe working railing and ladders as shown in FIGS. 1-7. There would be an accompanying personnel access gateway to facilitate access. Additionally, the top drive 34 is shown in FIG. 5 connected by a hook 36 via a set of bails 38 to the lift frame 10. During operation, the top drive 34 may be removed to allow additional operation head room.

In a preferred embodiment, the lift frame 10 may include more than one PCE such as a wireline surface PCE and/or a CT PCE. The lift frame 10 may also include a lubricator and a CT injector. Working access platform 20*c* provides access to an iron roughneck 40 for makeup and break out of tubulars and bottom hole assemblies for CT/WL operations. The lift frame 10 may also include winches and deployment aids for loading or removing tool strings from riser and transfer them to deck level.

In operation, the lift frame 10 is placed as shown in FIGS. 3-4. The lift frame 10 is engaged with elevators and guidance trolleys such that the lift frame 10 can be lifted to a position suitable to allow for the connection of a joint. The joint from the setback with piperackers and moved to the drill center 14 under the lift frame 10. A connector can be engaged with the lift frame 10.

While the invention has been described with reference to one or more particular embodiments, those skilled in the art will recognize that many changes may be made thereto without departing from the spirit and scope of the description. Each of these embodiments and obvious variations thereof is contemplated as falling within the spirit and scope of the claimed invention.

The invention claimed is:

1. A lift frame system comprising:

a lift frame capable of being moved from a stowed position to a drill center position of a drill floor;

a skidding pallet;

a plurality of working access platforms wherein each working access platform further comprises a least one ladder; and at least one personnel access and egress walkway platform wherein a first end of the personnel access and egress walkway platform engages an elevated platform above the drill floor and a second end of the personnel access and egress walkway platform is connected to one of the plurality of working access platforms.

2. The lift frame system of claim 1 wherein the skidding pallet is capable of moving along a plurality of rails on the drill floor.

3. The lift frame system of claim 1 wherein the lift frame is capable of engaging a multipurpose tower.

4. The lift frame system of claim 3 further comprising at least one stabilizing arm capable of engaging the multipurpose tower.

5. The lift frame system of claim 1 further comprising at least one coiled tubing injector.

6. The lift frame system of claim 1 further comprising at least one pressure control equipment.

7. The lift frame system of claim 1 further comprising at least one top drive.

8. The lift frame system of claim 1 further comprising at least one hook and at least one set of bails.

9. A method of using a lift frame system comprising the steps of:

moving a lift frame from a stowed position to a drill center position of a drill floor;

lifting at least one coiled tubing or wireline equipment with the lift frame; and connecting at least one personnel access and egress walkway platform to the lift frame, wherein the lift frame comprises a plurality of working access platforms and wherein each working access platform further comprises at least one ladder, wherein the personnel access and egress walkway platform engages an elevated platform above the drill floor at a first end of the personnel access and egress walkway platform and connects to one of the plurality of working access platforms at a second end of the personnel access and egress walkway platform.

10. The method of claim 9 wherein the step of moving the lift frame from the stowed position to the drill center position further comprises skidding the lift frame on a skidding palette.

11. The method of claim 9 wherein the lift frame is capable of engaging a multipurpose tower.

12. The method of claim 11 wherein the lift frame comprises at least one stabilizing arm capable of engaging the multipurpose tower.

13. The method of claim 9 wherein the lift frame comprises at least one coiled tubing injector.

14. The method of claim 9 wherein the lift frame comprises at least one pressure control equipment.

15. The method of claim 9 wherein the lift frame comprises at least one top drive.

16. The method of claim 9 wherein the lift frame comprises at least one hook and at least one set of bails.

* * * * *